US007249465B2

(12) United States Patent
Arman et al.

(10) Patent No.: US 7,249,465 B2
(45) Date of Patent: Jul. 31, 2007

(54) METHOD FOR OPERATING A CRYOCOOLER USING TEMPERATURE TRENDING MONITORING

(75) Inventors: Bayram Arman, Grand Island, NY (US); James J. Volk, Clarence, NY (US); Steve A. Richards, Somerset, NJ (US); Mushtaq M. Ahmed, Pittsford, NY (US); Arun Acharya, East Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 352 days.

(21) Appl. No.: 10/810,803

(22) Filed: Mar. 29, 2004

(65) Prior Publication Data

US 2005/0210889 A1 Sep. 29, 2005

(51) Int. Cl.
*F25B 9/00* (2006.01)
*G01L 25/00* (2006.01)
*G01M 7/00* (2006.01)

(52) U.S. Cl. ..... 62/6; 702/113

(58) Field of Classification Search ..... 62/6; 702/113

See application file for complete search history.

(56) References Cited

U.S. PATENT DOCUMENTS 5,113,663 A 5/1992 Gifford ..... 62/6
5,398,512 A 3/1995 Inaguchi et al. ..... 62/6
5,752,385 A * 5/1998 Nelson ..... 62/6
6,196,005 B1 * 3/2001 Stautner ..... 62/6
6,289,680 B1 * 9/2001 Oh et al. ..... 62/6
6,374,617 B1 4/2002 Bonaquist et al. ..... 62/6
6,378,312 B1 4/2002 Wang ..... 62/6
6,446,444 B1 * 9/2002 Chase et al. ..... 62/6
6,604,363 B2 8/2003 Corey et al. ..... 62/6
6,640,553 B1 11/2003 Kotsubo et al. ..... 62/6
6,644,038 B1 11/2003 Acharya et al. ..... 62/6
6,658,373 B2 * 12/2003 Rossi et al. ..... 702/185
2004/0030524 A1 * 2/2004 Jarrell et al. ..... 702/113

OTHER PUBLICATIONS

Ackermann et al., "Advanced Cryocooler Cooling for MRI Systems", Cryocoolers 10 (1999) pp. 857-867.
Castles et al., "Space Cryocooler Contamination Lessons Learned and Recommended Control Procedures", Cryocoolers 11 (2001) pp. 649-657.
Ackermann et al., "Cryogenic Refrigerator Evaluation for Medical and Rotating Machine Applications", Cryocoolers 12 (2003) pp. 805-811.

* cited by examiner

*Primary Examiner*—William C. Doerrler
(74) *Attorney, Agent, or Firm*—David M. Rosenblum

(57) ABSTRACT

A method for operating a cryocooler which provides opportunity for timely intervention prior to failure thus enhancing the reliability of the provision of the refrigeration wherein temperature trending of at least one cryocooler component or the refrigeration load is monitored and used to calculate a service time.

5 Claims, 4 Drawing Sheets

METHOD FOR OPERATING A CRYOCOOLER USING TEMPERATURE TRENDING MONITORING

TECHNICAL FIELD

This invention relates generally to low temperature or cryogenic refrigeration and, more particularly, to the operation of a cryocooler.

BACKGROUND ART

Cryocoolers are employed to generate refrigeration and to provide that refrigeration for applications such as high temperature superconductivity and magnetic resonance imaging. Failure of the cryocooler can have severe consequences for such application systems. It is desirable therefore to operate a cryocooler so as to avoid the failure of the cryocooler while it is on line.

Accordingly, it is an object of this invention to provide a method for operating a cryocooler so as to reduce or eliminate the likelihood of the cryocooler failing while it is on line and providing critical refrigeration to an application such as a magnetic resonance imaging system or a high temperature superconductivity application.

SUMMARY OF THE INVENTION

The above and other objects, which will become apparent to those skilled in the art upon a reading of this disclosure, are attained by the present invention which is:

A method for operating a cryocooler for providing refrigeration to a refrigeration load comprising:

(A) generating refrigeration by operating a cryocooler having a regenerator, a cold heat exchanger and a thermal buffer tube;

(B) monitoring temperature trending of at least one of the regenerator, the cold heat exchanger, the thermal buffer tube and the refrigeration load, and employing the temperature trending to calculate a service time; and (C) servicing the cryocooler if the calculated service time is less than a predetermined value.

As used herein the term "temperature trending" means temporal temperature such as, for example, rate of temperature change, circumferential temperature variation, or temperature profile.

As used herein the term "service time" means the time remaining for a component before it needs maintenance or replacement.

As used herein the term "regenerator" means a thermal device in the form of porous distributed mass or media, such as spheres, stacked screens, perforated metal sheets and the like, with good thermal capacity to cool incoming warm gas and warm returning cold gas via direct heat transfer with the porous distributed mass.

As used herein the term "thermal buffer tube" means a cryocooler component separate from the regenerator and proximate the cold heat exchanger and spanning a temperature range from the coldest to the warmer heat rejection temperature for that stage.

As used herein the term "indirect heat exchange" means the bringing of fluids into heat exchange relation without any physical contact or intermixing of the fluids with each other.

As used herein the term "direct heat exchange" means the transfer of refrigeration through contact of cooling and heating entities.

As used herein the term "frequency modulation valve" means a valve or system of valves generating oscillating pressure and mass flow at a desired frequency.

DETAILED DESCRIPTION

Figure 1:
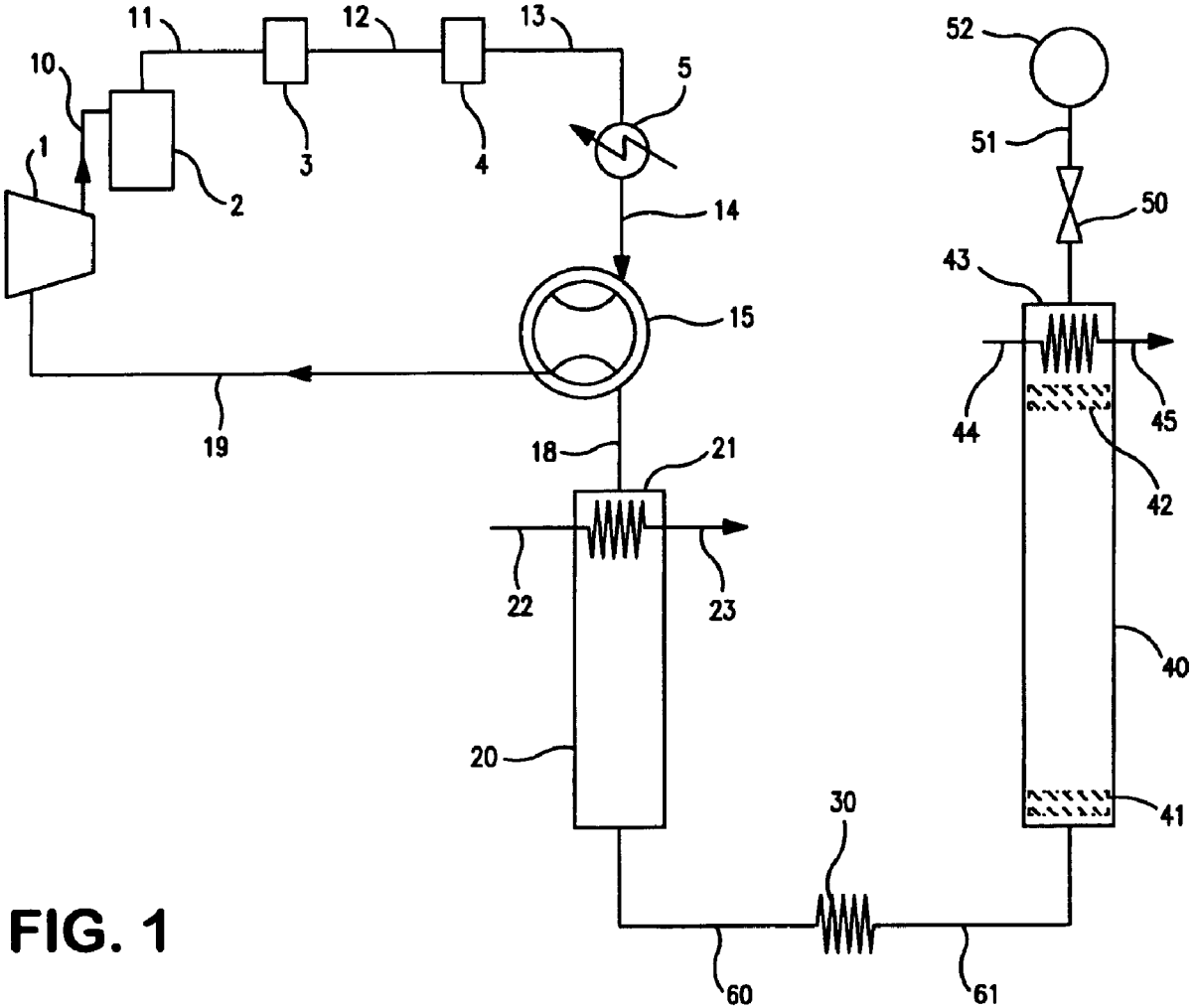
FIG. 1 is a schematic representation of one preferred embodiment of a cryocooler system which may be employed in the practice of this invention.

In general the invention is a method for operating a cryocooler using temperature trending as a diagnostic tool to provide advance warning of a cryocooler system failure or degradation which facilitates timely intervention to service or replace one or more components of the cryocooler before the operation of the application receiving the refrigeration from the cryocooler is compromised.

The Figure illustrates one preferred embodiment of a cryocooler which will benefit from the practice of this invention. Referring now to the Figure, cryocooler working gas, such as helium, neon, hydrogen, nitrogen, argon, oxygen and mixtures thereof, with helium being preferred, is compressed in oil flooded compressor 1. The compressed working gas is passed in line 10 to coalescing filter or filters 2 which is part of the oil removal train which also includes adsorptive separator 3 and ultrafine filter 4. The working gas passes from coalescing filter 2 to adsorptive separator 3 in line 11, and from adsorptive separator 3 to ultrafine filter 4 in line 12.

Coalescing filter 2 removes oil droplets and mist, and adsorptive separator bed 3 removes oil vapor. Ultrafine filter 4 removes any remaining micro particulates and extra fine oil mist. At the end of the oil removal train, the oil related impurity or contamination level of the working gas in line 13 is less than 1 ppbv. Typical bed materials for the adsorptive bed 3 could be a zeolite, activated carbon and alumina. Heat of compression from the working gas is removed in an aftercooler 5 which may be located anywhere between the frequency modulation valve 15 and compressor discharge line 11. Rotary frequency modulation valve 15 connects clean discharge 14 or suction 19 of the compressor with line 18 to produce necessary oscillations to drive the coldhead. The rotary valve is driven by a motorized system (not shown). The operating frequency of the cryocooler may be up to the range of from 50 to 60 hertz, although it is typically less than 30 hertz, preferably less than 10 hertz, and most preferably less than 5 hertz.

The pulsing working gas applies a pulse to the hot end of regenerator 20 thereby generating an oscillating working gas and initiating the first part of the pulse tube sequence. The pulse serves to compress the working gas producing hot compressed working gas at the hot end of the regenerator 20. The hot working gas is cooled, preferably by indirect heat exchange with heat transfer fluid 22 in heat exchanger 21, to produce warmed heat transfer fluid in stream 23 and to cool the compressed working gas of the heat of compression. Examples of fluids useful as the heat transfer fluid 22, 23 in the practice of this invention include water, air, ethylene glycol and the like. Heat exchanger 21 is the heat sink for the heat pumped from the refrigeration load against the temperature gradient by the regenerator 20 as a result of the pressure-volume work generated by the compressor and the frequency modulation valve.

Regenerator 20 contains regenerator or heat transfer media. Examples of suitable heat transfer media in the practice of this invention include steel balls, wire mesh, high density honeycomb structures, expanded metals, lead balls, copper and its alloys, complexes of rare earth element(s) and transition metals. The pulsing or oscillating working gas is cooled in regenerator 20 by direct heat exchange with cold regenerator media to produce cold pulse tube working gas.

Thermal buffer tube 40 and regenerator 20 are in flow communication. The flow communication includes cold heat exchanger 30. The cold working gas passes in line 60 to cold heat exchanger 30 and in line 61 from cold heat exchanger 30 to the cold end of thermal buffer tube 40. Within cold heat exchanger 30 the cold working gas is warmed by indirect heat exchange with a refrigeration load thereby providing refrigeration to the refrigeration load. This heat exchange with the refrigeration load is not illustrated. One example of a refrigeration load is for use in a magnetic resonance imaging system. Another example of a refrigeration load is for use in high temperature superconductivity.

The working gas is passed from the regenerator 20 to thermal buffer tube 40 at the cold end. Preferably, as illustrated in the Figure thermal buffer tube 40 has a flow straightener 41 at its cold end and a flow straightener 42 at its hot end. As the working gas passes into thermal buffer tube 40 it compresses gas in the thermal buffer tube and forces some of the gas through heat exchanger 43 and orifice 50 in line 51 into reservoir 52. Flow stops when pressures in both the thermal buffer tube and the reservoir are equalized.

Cooling fluid 44 is passed to heat exchanger 43 wherein it is warmed or vaporized by indirect heat exchange with the working gas, thus serving as a heat sink to cool the compressed working gas. Resulting warmed or vaporized cooling fluid is withdrawn from heat exchanger 43 in stream 45. Preferably cooling fluid 44 is water, air, ethylene glycol or the like.

In the low pressure point of the pulsing sequence, the working gas within the thermal buffer tube expands and thus cools, and the flow is reversed from the now relatively higher pressure reservoir 52 into the thermal buffer tube 40. The cold working gas is pushed into the cold heat exchanger 30 and back towards the warm end of the regenerator while providing refrigeration at heat exchanger 30 and cooling the regenerator heat transfer media for the next pulsing sequence. Orifice 50 and reservoir 52 are employed to maintain the pressure and flow waves in appropriate phase so that the thermal buffer tube generates net refrigeration during the compression and the expansion cycles in the cold end of thermal buffer tube 40. Other means for maintaining the pressure and flow waves in phase which may be used in the practice of this invention include inertance tube and orifice, expander, linear alternator, bellows arrangements, and a work recovery line connected back to the compressor with a mass flux suppressor. In the expansion sequence, the working gas expands to produce working gas at the cold end of the thermal buffer tube 40. The expanded gas reverses its direction such that it flows from the thermal buffer tube toward regenerator 20. The relatively higher pressure gas in the reservoir flows through valve 50 to the warm end of the thermal buffer tube 40. In summary, thermal buffer tube 40 rejects the remainder of pressure-volume work generated by the compression and frequency modulation system as heat into warm heat exchanger 43.

The expanded working gas emerging from heat exchanger 30 is passed in line 60 to regenerator 20 wherein it directly contacts the heat transfer media within the regenerator to produce the aforesaid cold heat transfer media, thereby completing the second part of the cryocooler refrigeration sequence and putting the regenerator into condition for the first part of a subsequent cryocooler refrigeration sequence. Pulsing gas from regenerator 20 passes back to rotary valve 15 and in suction conduit 19 to compressor 1.

The performance of the cryocooler may degrade with time. The degradation or change in performance could be due to contamination and associated freezing, cold plunger and associated equipment failure in the coldhead, and damage to other internal coldhead hardware. The contamination could be due to failure or equipment sub-performance in the oil removal train, impure working gas supply, air leakage through the flanges, off gassing of the components especially elastomers and plastics, or products from oil degradation. As a result the temperature of cold heat exchanger 30 degrades with time. The rate of degradation could be different depending on the causes in play. For example, it will be different for freezing of different contaminants and their respective amounts. Some contaminants such as hydrogen could freeze within the cold heat exchanger 30, cold end of the regenerator 20 or cold end of the thermal buffer tube 40; however moisture will freeze close to the warm end of regenerator 20 if it enters into the system while the cryocooler is operating. The same moisture could accumulate at colder locations if present before the cryocooler started its operation. In addition various failures will also impact the cryocooler performance differently. This phenomenon is captured only by observing the rate of change within a meaningful time interval (critical time interval $\tau_{critical}$)

Temperatures may be measured using temperature probes such as thermocouples, diodes and the like. These probes could be mounted on the surface of the equipment. The signal from the probes may be received by temperature reading equipment that could stand alone or be computer driven. The signal is interpreted by the temperature reading equipment as a temperature value or values. A data acquisition system connected to this temperature reading equipment logs and/or plots the data as a function of time. The data is preferably plotted in a graphical form to help visualization.

Figure 2:
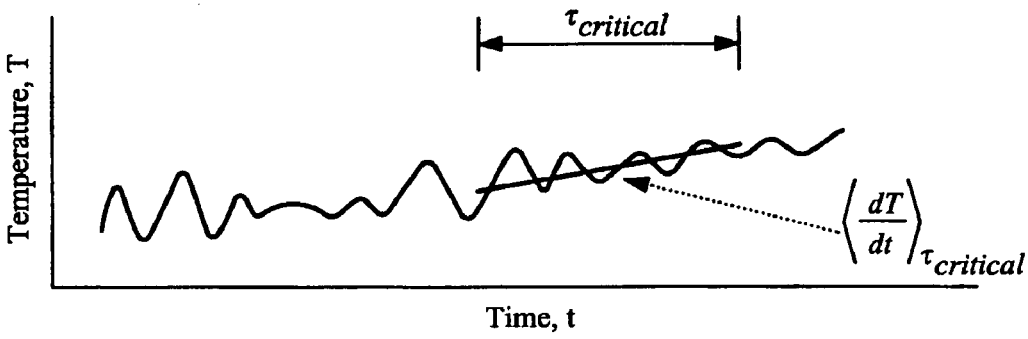
FIG. 2 is a graph illustration of a noisy temperature signal.

FIG. 2 depicts a noisy temperature signal and $\tau_{critical}$ in a pictorial manner.

In the case where the cryocooler under its design load operates at a temperature $T_c$ and the maximum temperature that could be tolerated for the operation of a superconducting system is $T_h$, one can define the cryocooler operating window as between $T_c$ and $T_h$. The invention uses the time-averaged rate of temperature change to monitor the system. The time averaged temperature change is defined by $$\left\langle \frac{dT}{dt} \right\rangle_{\tau_{critical}}$$

and the time averaging eliminates measurement noise. If $$\left\langle \frac{dT}{dt} \right\rangle_{\tau_{critical}}$$

is negative then, the diagnostics system provides warning to the operator or control system to ensure that the cryogenic system does not get colder than $T_c$. If $$\left\langle \frac{dT}{dt} \right\rangle_{\tau_{critical}}$$

is positive i.e., the system is warming, then the estimated time to service is given by the following formulas $$\Delta t_{service} = \frac{(Th - T)}{\left\langle \frac{dT}{dt} \right\rangle_{\tau_{critical}}}$$

Figure 3:
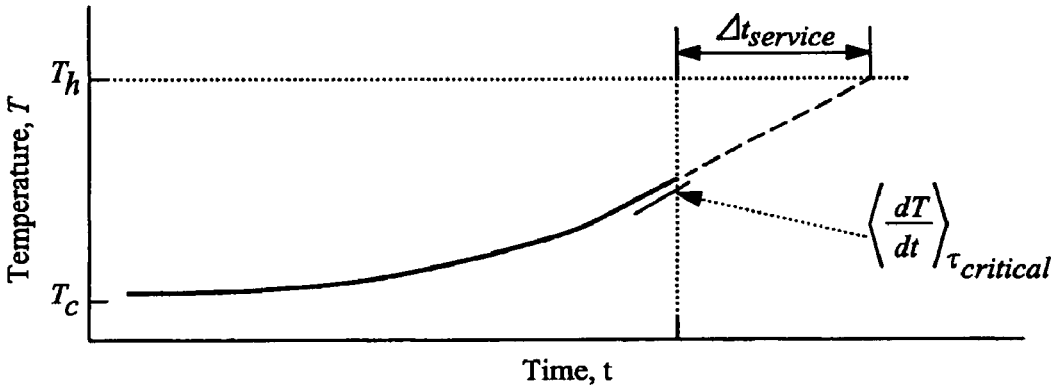
FIG. 3 is a graph illustration of a temperature data and $\Delta t_{service}$.

FIG. 3 depicts a temperature data and $\Delta t_{service}$ in a pictorial manner.

For example, in a cryocooler application where $T_c$ and Th are 20 and 30K, respectively, at time t, the cryocooler cold heat exchanger temperature T is 24K at constant heat load. The operator or control system measured T=23.8K at time t=−20 h. The service time is calculated as follows:

$$\left\langle \frac{dT}{dt} \right\rangle_{\tau_{critical}} = (24 - 23.9)/20 = 0.005 \text{ K/h then}$$

$$\Delta t_{service} = (30 - 24)/0.005 = 1200 \text{ h or } 1200/24 = 50 \text{ days.}$$

then $$\Delta t_{service} = (30-24)/0.005 = 1200\text{h or } 1200/24 = 50 \text{ days.}$$

If the calculated service time is larger than 100 days, then nothing is required. If the calculated service time between 10-100 days, check other influential cryocooler parameters such as pressure, pressure drops and other diagnostic data available to warn the operators to closely watch the cryogenic system. If the calculated service time is less than 10 days, make necessary changes while system is running. If the trend does not reverse, then replace or repair the cold-head or the pressure wave generation system. Additionally, the cryocooler may be serviced when $(T_h - T) \leqq 0.1(T_h - T_c)$.

Other temperature readings than cold heat exchanger 30 temperature could also be used for monitoring purpose. For example the temperature of the refrigeration load could be monitored. Also, the circumferential temperature variation of the regenerator 20 could provide information on onset of flow maldistribution within the regenerator. Preferably temperatures are monitored at the mid-axial location of the regenerator.

Figure 4:
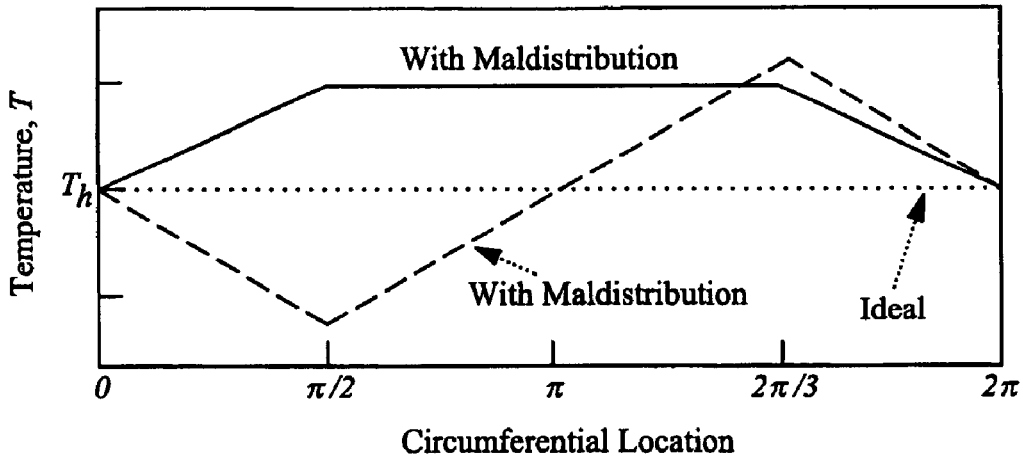
FIG. 4 shows a profile of an ideal regenerator and one with maldistribution; Corresponding mid point temperature profile are also depicted.

FIG. 4 shows a profile of an ideal regenerator and one with a maldistribution. Corresponding midpoint temperature profiles are also depicted.

Figure 5:
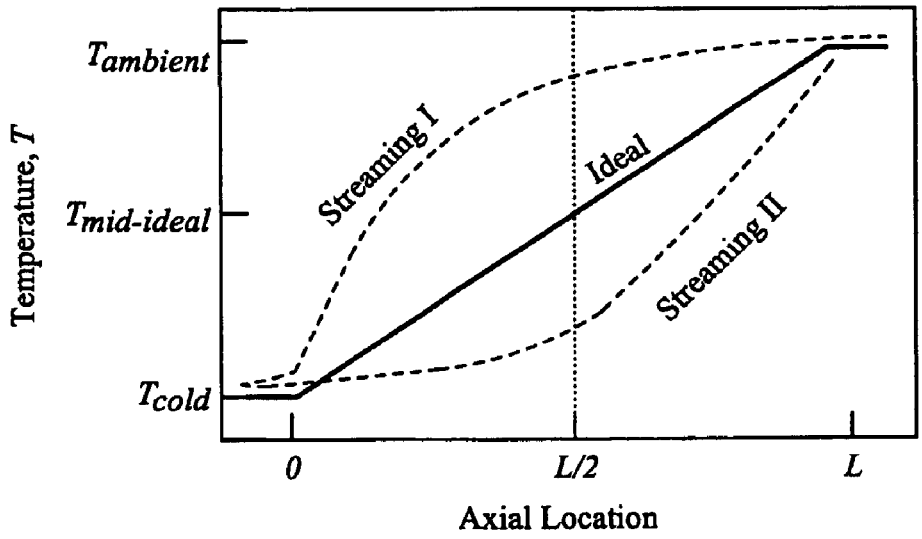
FIG. 5 is a graph illustration of a thermal buffer tube temperature profile.

Additionally, the change in thermal buffer tube 40 axial temperature profile can also be a very good diagnostic tool. The ideal thermal buffer tube temperature profile in pulse tube geometry is linear as shown in FIG. 5. When a cryocooler develops problems this profile deviates from the ideal or initial profile as shown, thus the thermal buffer tube temperature would be different than its ideal or initial value.

Figure 6:
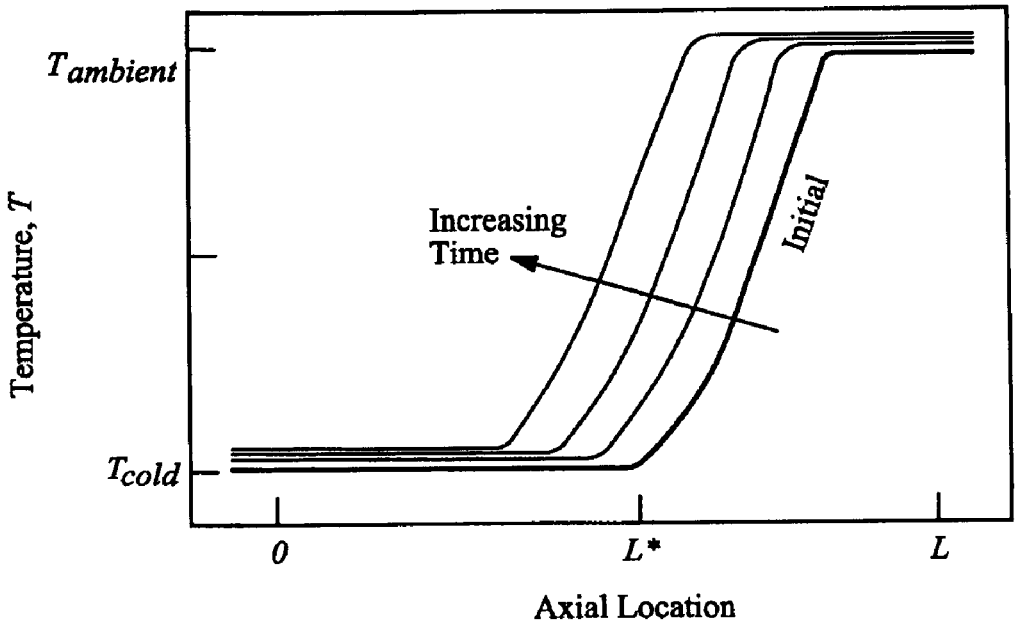
FIG. 6 is a graph illustration of a temperature profile in a displacer-type thermal buffer tube.
Figure 7:
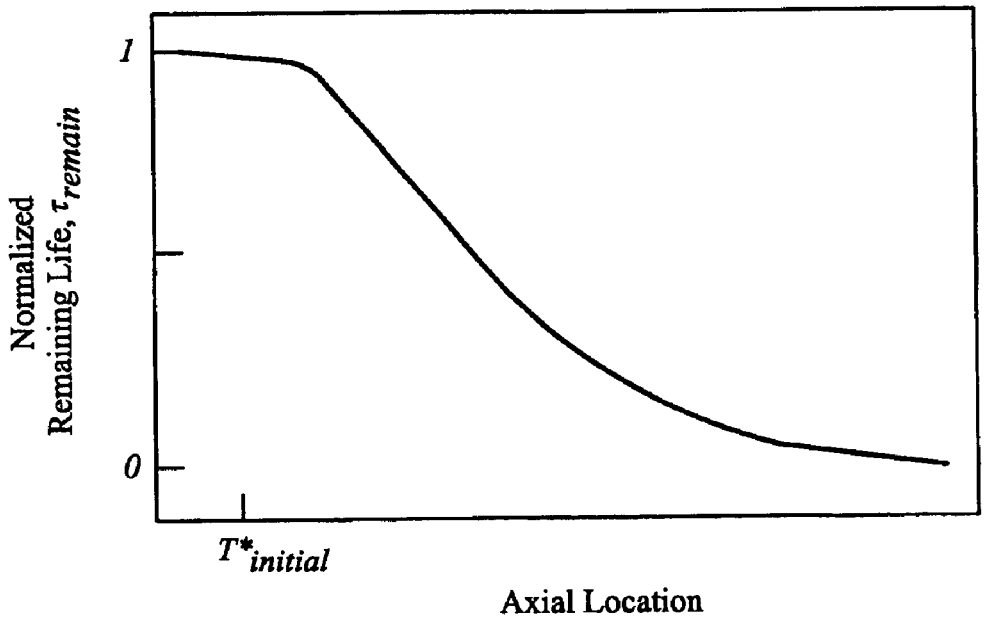
FIG. 7 is a graph illustration of normalized remaining life as a function of temperature at a prescribed location.

As shown in FIG. 6 displacer-type thermal buffer tube in cryocooler exhibit different temperature profile that can also be used as diagnostic tool as shown in the graph below. Typical temperature profile is drawn as initial and the profile will shift as the displacer seals wear with time. With reference to FIG. 7 normalized remaining life as a function of temperature T* at a prescribed location L* is shown. This temperature could be used to predict when the cryocooler displacer and seals should be serviced.

Although the invention has been described in detail with reference to certain preferred embodiments, those skilled in the art will recognize that there are other embodiments of the invention within the spirit and the scope of the claims.

The invention claimed is:

1. A method for operating a cryocooler for providing refrigeration to a refrigeration load comprising:

(A) generating refrigeration by operating a cryocooler having a regenerator, a cold heat exchanger and a thermal buffer tube;

(B) monitoring temperature trending of at least one of the circumferential temperature variation of the regenerator and the temperature profile of the thermal buffer tube and employing the temperature trending to calculate a service time; and (C) servicing the cryocooler if the calculated service time is less than a predetermined value.

2. The method of claim 1 wherein the temperature trending that is monitored is both the rate of temperature change of the cold heat exchanger and the at least one of the circumferential temperature variation of the regenerator and the temperature profile of the thermal buffer tube.

3. The method of claim 1 wherein the temperature trending that is monitored is both the temperature of the refrigeration load and the at least one of the circumferential temperature variation of the regenerator and the temperature profile of the thermal buffer tube.

4. The method of claim 1 wherein the predetermined value is ten days.

5. The method of claim 1 wherein the cryocooler is operating at less than 30 hertz.

* * * * *